US005561018A

United States Patent [19]

Moriya

[11] Patent Number: 5,561,018

[45] Date of Patent: Oct. 1, 1996

[54] MAGNETIC TONER

[75] Inventor: Yuichi Moriya, Shizuoka, Japan

[73] Assignee: Tomoegawa Paper Co., Ltd., Tokyo, Japan

[21] Appl. No.: 344,628

[22] Filed: Nov. 17, 1994

Related U.S. Application Data

[63] Continuation of Ser. No. 74,011, Jun. 9, 1993, abandoned, which is a continuation of Ser. No. 681,892, Apr. 8, 1991, abandoned.

[30] Foreign Application Priority Data

Apr. 11, 1990 [JP] Japan ..... 2-93856

[51] Int. Cl.[6] ..... G03G 9/083

[52] U.S. Cl. ..... 430/106.6; 430/111; 430/137

[58] Field of Search ..... 430/106.6, 111, 430/137, 903

[56] References Cited

U.S. PATENT DOCUMENTS

| | | | |
|---|---|---|---|
| 4,946,755 | 8/1990 | Inoue | 430/106.6 |
| 5,223,365 | 6/1993 | Yamamoto et al. | 430/137 |
| 5,334,472 | 8/1994 | Aoki et al. | 430/110 |

FOREIGN PATENT DOCUMENTS

| | | |
|---|---|---|
| 0238130A2 | 9/1987 | European Pat. Off. . |
| 0357042A2 | 3/1990 | European Pat. Off. . |
| 0395026A2 | 10/1990 | European Pat. Off. . |
| 0410483A1 | 1/1991 | European Pat. Off. . |

*Primary Examiner*—Christopher D. Rodee

*Attorney, Agent, or Firm*—Finnegan, Henderson, Farabow, Garrett & Dunner, L.L.P.

[57] ABSTRACT

A magnetic toner having a specific surface area of not more than 3.0 $m^2/g$ computed by the Brunauer Emmett Teller equation and the number of molecules of $CO_2$ gas, being equal to $100/nm^2$ to $1000/nm^2$, adsorbed by the toner is provided. The triboelectrification of magnetic toner particles of the magnetic toner is uniformed by adjusting the magnetic toner using an impact force so that the specific surface area of the magnetic toner and the number of molecules of $CO_2$ gas adsorbed by the toner are presented in the range described above.

11 Claims, 3 Drawing Sheets

MAGNETIC TONER

This application is a continuation, of application Ser. No 08/074,001 filed Jun. 9, 1993, now abandoned, which is a continuation of application Ser. No. 7/681,892, filed Apr. 8, 1991, now abandoned.

BACKGROUND OF THE INVENTION

1. Field of the Invention

The present invention relates to magnetic toners including magnetic powder for developing electrostatically charged images in electrophotographic methods, electrostatatic-printing recording methods, and the like.

2. Prior Art

In general, electrophotographic methods comprise the steps of: forming an electric latent image on a sensitizing material; developing the latent image with toners to form a toner image; optionally transferring the toner image to a decalcomania material such as paper; and fixing the toner image by means of heating, pressurization, and the like to obtain a copy. Classes of developers for use in such electrophotographic methods include two-component developers consisting of a toner and a carrier, and single-component developers consisting of only a toner which also functions as a carrier.

As the single-component developer, so-called magnetic toners can be used. The magnetic toners include magnetic powder in an amount of approximately 10% to 70%. Generally, magnetic toners are roughly divided into conductive magnetic toners and insulating magnetic toners. The insulating magnetic toners have been used not only in single-component contact or non-contact developing systems, but also in two-component developing systems with appropriate carriers.

In such a single-component developing system, it is extremely important that the magnetic toners retain triboelectrification (triboelectrification: the production of electrostatic charges by friction), since the single-component developer includes no carriers functioning to accelerate triboelectrification of the magnetic toners. Namely, a "triboelectrification property" which means that triboelectrification of magnetic toners speedily reaches a saturated value by causing the magnetic toner particles to come into light contact with one another or with a doctor blade or the like, largely affects durability of the magnetic toners and developing characteristics such as image density, smudging, image quality, and the like.

In the two-component developing system mentioned above, a suitable triboelectrification is necessary in order to obtain stable developing characteristics at low toner-density as well as at a high toner-density, since almost all developing machines used in the two-component developing system are not sophisticated enough to control toner-density.

In addition, since a magnetic toner particle is a mixture of magnetic powder, a binder resin, an electrostatic charge control agent, and the like and such materials tend to exist nonuniformly on the surface of the magnetic toner particles, each magnetic toner particle does not always have uniform triboelectrification properties. Therefore, in order to obtain magnetic toner particles having uniform triboelectrification, it has been proposed that developing characteristics can be improved by improving uniformity of the size of the magnetic toner particles by classifying such as to remove coarse particles and fine particles; or adhering or fixing various additives which participate in the triboelectrification on the surface of each magnetic toner particle. However, the conventional magnetic toners described above do not have sufficiently uniform triboelectrification properties which are desirable for magnetic toners.

SUMMARY OF THE INVENTION

In order to solve the problems described above, it is an object of the present invention is to provide a magnetic toner which exhibits good triboelectrification properties, i.e. characteristics of speedy rise time of triboelectrification in both single-component developing systems and two-component developing systems. The magnetic toners according to the present invention can contribute to obtaining multiple copies having a superior image quality and density without smudging in both copy machines using a single-component developing system and laser printers using a two-component developing system.

Therefore, one aspect of the present invention is directed to providing a magnetic toner having a specific surface area of not more than 3.0 $m^2/g$ computed by the Brunauer Emmett Teller equation (hereafter, it is abbreviated to as "BET equation") and the number of molecules of $CO_2$ gas, being equal to $100/nm^2$ to $1000/nm^2$, adsorbed by the magnetic toner.

The above objects, effects, features, and advantages of the present invention will become more apparent from the following description of preferred embodiments thereof.

DETAILED DESCRIPTION OF THE INVENTION

Figure 1:
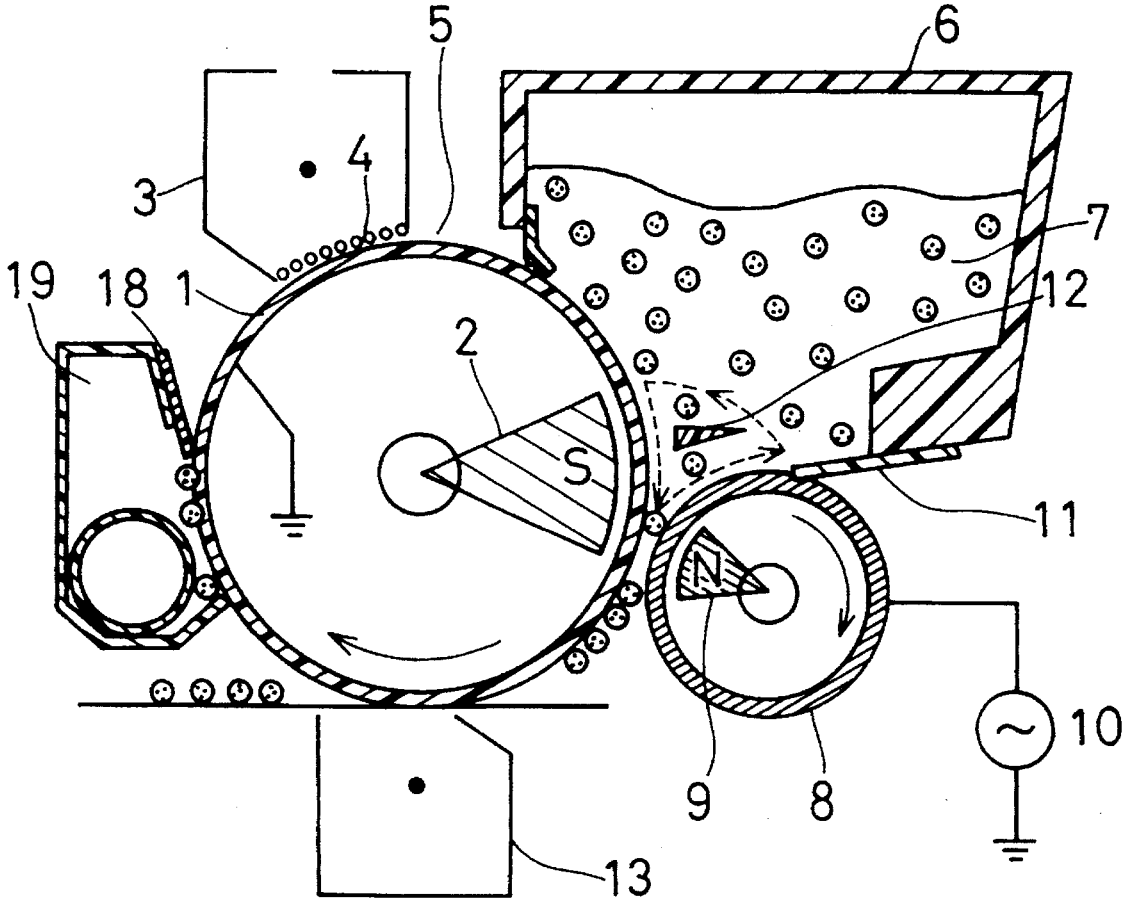
FIG. 1 is a graph showing characteristics of rise time of triboelectrification of magnetic toners according to Examples 1 to 3 of the present invention and the Comparative Example.

When obtained by kneading raw materials described below by a melt-kneading machine such as a hot roll, a kneader, an extruder, or the like; pulverizing the kneaded mixture by a mill; and classifying the pulverized mixture to obtain a magnetic toner having an average particle size of 4 to 20 μm, a magnetic toner according to the present invention having a specific surface area of not more than 3.0 $m^2/g$ computed by BET equation and the number of molecules of $CO_2$ gas, being equal to $100/nm^2$ to $1000/nm^2$, adsorbed by the magnetic toner can be obtained by a particular pulverization method in the pulverizing step or by an aftertreatment after the classifying step mentioned above.

Namely, in order to obtain a magnetic toner having the above-mentioned specific surface area and the number of molecules of adsorbed $CO_2$ gas, an impact force is added to a magnetic toner to be manufactured. For example, such a desired magnetic toner can be formed by (a) subjecting crude magnetic toners to multiple physical impacts having a reduced force in the pulverizing step; or (b) pulverizing crude magnetic toners, classifying the pulverized magnetic toners, and treating the classifying magnetic toners by a fluid stirrer such as a high-speed mixer ("Henscheil Mixer", produced by Mitsui Miike Engineering Co., Ltd.) for a fixed time or by a surface reformer such as "Nara Hybridization System, NHS-1 type", produced by Nara Machinery Co., Ltd. with a strong impact force.

If a magnetic toner has a specific surface area of over 3.0 $m^2/g$, each of the toner particles has a highly irregular surface, for which reason, the toner particles do not adequately contact one another and carrier particles. Such a magnetic toner has the disadvantages that the triboelectrification thereof is unstable and the magnetic toner splashes during copying.

If the number of molecules of $CO_2$ gas adsorbed by the magnetic toner is below $100/nm^2$, image quality is poor or smudging occurs since not all of the magnetic toner particles participate in development of the sensitized material. On the other hand, when the number of molecules of $CO_2$ gas adsorbed by the magnetic toner is above $1000/nm^2$, the toner has disadvantages such that water absorption thereof is increased, the triboelectrification thereof is reduced, and smudging occurs at high temperatures and high humidity due to polar characteristics of $CO_2$ molecules.

In the present invention, the number of molecules of $CO_2$ gas adsorbed by the magnetic toner is preferably in the range of $100/nm^2$ to $500/nm^2$, in which case, the stable characteristics of rise time of triboelectrification and reduced humidity dependency are obtained.

The specific surface area of the magnetic toner and the number of molecules of $CO_2$ gas adsorbed by the magnetic toner can be measured by using a commercially available full-automatic gas adsorption apparatus ("BELSORP 28", produced by Bell Japan, Inc.) and the like. In this case, the specific surface area is computed by BET equation. As the adsorption gas, an inert gas such as $N_2$ gas is used. Concretely, adsorption Vm (cc/g) needed to form a monomolecular layer on a surface of a magnetic toner is measured and a specific surface area S ($m^2/g$) can be calculated by the following equation:

$$S(m^2/g)=4.35\times Vm$$

In general, the specific surface area of a magnetic toner is increased when the average particle size of magnetic toner is decreased. Accordingly, in the case where the specific surface area of the magnetic toner is not more than 5 $m^2/g$ in the present invention, the average particle size thereof is in the range of 4–20 μm, and in the case where the specific surface area of the magnetic toner is not more than 3 $m_2/g$, the average particle size thereof is in the range of 8–20 μm. The average particle sizes described above are measured using Coulter counter method. In addition, the specific surface area of the magnetic toner is adversely affected by increasing the amount of the magnetic powder included in the magnetic toner because the magnetic toner increases in weight when the amount of magnetic powder included in the magnetic toner is increased. In the present invention, the magnetic powder is contained in the magnetic toner in the amount of 10 to 70%.

The number of molecules of $CO_2$ gas adsorbed by a magnetic toner can be computed by the following equation:

$$[\text{the number of molecules of } CO_2 \text{ gas adsorbed by a magnetic toner}]\ (\text{the number}/nm^2) = \frac{[\text{adsorbed } CO_2 \text{ gas}] \times 6.02 \times 10^{23}}{22414 \times [\text{the specific surface area}] \times 10^{18}}$$

Next, the materials which compose the magnetic toner according to the present invention will be described in detail.

The magnetic toner of the present invention contains a magnetic material and a binder resin as main ingredients. As the magnetic material, magnetite, ferrite, or the like, which has crystallographically a spinel, perovskite, hexagonal, garnet, orthoferrite structure can be used in the present invention. More particularly, the magnetic material is a sintered compact of iron(III) oxide (ferric oxide) and an oxide of nickel, zinc, manganese, magnesium, copper, lithium, barium, vanadium, chromium, calcium, or the like.

In addition, a suitable binder resin for the magnetic toner according to the present invention may include a thermoplastic resin such as a monomer of polystyrene, polyethylene, polypropylene, a vinyl resin, polyacrylate, polymethacrylate, polyvinylidene chloride, polyacrylonitrile, polyether, polycarbonate, thermoplastic polyester, or a cellulose resin, or a copolymer resin of the monomers listed above; and a thermosetting resin such as a modified acrylate resin, phenol resin, melamine resin, urea resin, or the like.

In addition, various additives may be added to the magnetic toner of the present invention as necessary. Examples of the additives include charge control agents such as metal monoazo dyes, nigrosine dye, or the like; a coloring agent such as carbon black, or the like; and a fluidity modifier such as a colloidal silica, a metal salt of an aliphatic acid, or the like.

According to the present invention, the triboelectrification of magnetic toner particles of the magnetic toner is made uniform by pulverizing the magnetic toner using an impact force so that the specific surface area of the magnetic toner and the number of molecules of $CO_2$ gas adsorbed by the toner produced thereby is in the range described above. In the case where the number of molecules of $CO_2$ gas adsorbed by the magnetic toner is increased, the surface of the magnetic toner is activated with respect to chemical adsorption. In this activated condition, it is believed that the surface of the magnetic toner can be easily triboelectrified. However, the triboelectrification is adversely affected by increasing the $CO_2$ gas adsorption because the water absorption is proportionally increased to the $CO_2$ gas adsorption. Therefore, both good characteristics of rise time of triboelectrification and uniformity of electrostatic charge can be obtained by adjusting the number of molecules of $CO_2$ gas adsorbed by the magnetic toner in an appropriate range.

EXAMPLES

The present invention will be explained in detail hereinbelow with reference to examples. In the examples, all "parts" are by weight.

Example 1

| | | |
|---|---|---|
| a) | Styrene/acryl copolymer (Mn = 5,000, Mw = 140,000) | 100 parts |
| b) | Magnetite ("EPT-500", produced by Toda Kogyo Corp.) | 56 parts |
| c) | Azo-type chrome complex dye ("BONTRON S-34", produced by Orient Chemical Industrial Co., Ltd.) | 1.6 parts |
| d) | Polypropylene ("VISCOL 550P", produced by Sanyo Chemical Industries, Ltd.) | 3.2 parts |

The mixture of the above-described composition was heat-melted and kneaded by means of a biaxial kneading machine. The kneaded mixture was cooled and pulverized by a jet mill. The pulverized mixture was classifying by an air classifier to obtain fine particles (I).

The condition of the pulverizing step by means of a jet mill is presented as follows:

| | | |
|---|---|---|
| a) | Jet mill ("IDS-2 type", produced by Nippon Pneumatic Mfg. Co., Ltd.) | |
| b) | Angle of a collision plate | 45° |
| c) | Pulverization pressure (Compressed air) | 4 kg/cm$^2$ |
| d) | Throughput | 1.6 kg/h |

To 100 parts of the fine particles (I) obtained above was added 0.3 parts of hydrophobic silica ("R-972", produced by Nippon Aerosil Co., Ltd.). In order to cause the silica to adhere to the surface of the particle, the mixture was mixed for approximately 1 or 2 minutes by means of a high-speed mixing machine ("Super Mixer", produced by Kawada Mfg. Co., Ltd.) at a peripheral speed at the blade tip equal to at most 20 m/sec. to obtain a magnetic toner according to the present invention, having an average particle diameter of 10 μm.

The specific surface area of the magnetic toner and the number of molecules of $CO_2$ gas adsorbed by the magnetic toner according to the present invention were measured by means of a full-automatic gas adsorption apparatus ("BEL-SORP 28", produced by Bell, Japan Inc.). The results are as follows:

| | |
|---|---|
| Specific surface area of the magnetic toner | 1.98 m$^2$/g |
| The number of molecules of $CO_2$ gas adsorbed by the magnetic toner | 268.3/nm$^2$ |

Example 2

| | | |
|---|---|---|
| a) | Styrene/acryl copolymer (Mn = 5,000, Mw = 140,000) | 100 parts |
| b) | Magnetite ("EPT-500", produced by Toda Kogyo Corp.) | 56 parts |
| c) | Azo-type chrome complex dye ("BONTRON S-34", produced by Orient Chemical Industrial Co., Ltd.) | 1.6 parts |
| d) | Polypropylene ("VISCOL 550P", produced by Sanyo Chemical Industries, Ltd.) | 3.2 parts |

The mixture of the above-described composition was heat-melted and kneaded by means of a biaxial kneading machine. The kneaded mixture was cooled and pulverized by a mill. The pulverized mixture was classifying by an air classifier to obtain fine particles (II).

The condition of the pulverizing step by means of a jet mill is presented as follows:

| | | |
|---|---|---|
| a) | Jet mill ("IDS-2 type", produced by Nippon Pneumatic Mfg. Co., Ltd.) | |
| b) | Angle of a collision plate | 90° |
| c) | Pulverization pressure (Compressed Air) | 6 kg/cm$^2$ |
| d) | Throughput | 3.0 kg/h |

It is noted that the object to be pulverized is more pulverized when the angle of the collision plate is 90° as compared with 45°.

Next, the fine particles (II) obtained above were aftertreated by stirring in "Henscheil Mixer" (a moving blade of "CK/BO type") at a peripheral speed at the moving blade tip equal to 30 m/sec for 10 minutes.

To 100 parts of the aftertreated fine particles was added 0.3 parts of hydrophobic silica ("R-972", produced by Nippon Aerosil Co., Ltd.). The mixture was mixed for approximately 1 or 2 minutes by means of "Super Mixer" at a peripheral speed at the blade tip equal to at most 20 m/sec. to obtain a magnetic toner according to the present invention, having an average particle diameter of 10 μm.

The specific surface area of the magnetic toner and the number of molecules of $CO_2$ gas adsorbed by the toner according to the present invention were measured by repeating the same procedure as described in Example 1. The results are as follows:

| | |
|---|---|
| Specific surface area of the magnetic toner | 2.13 m$^2$/g |
| The number of molecules of $CO_2$ gas adsorbed by the magnetic toner | 320.1/nm$^2$ |

Example 3

Fine particles (II) were prepared by repeating the same procedures as described in Example 2. The fine particles (II) were put in a surface reformer ("Nara Hybridization System, NHS-1 type", produced by Nara Machinery Co., Ltd.) and aftertreated at 5000 rpm for 3 minutes. To 100 parts of the treated fine particles was added 0.3 parts of hydrophobic silica ("R-972", produced by Nippon Aerosil Co., Ltd.). The mixture was mixed for approximately 1 or 2 minutes by means of "Super Mixer" at a peripheral speed at the blade tip equal to at most 20 m/sec. to obtain a magnetic toner according to the present invention, having an average particle diameter of 10 μm.

The specific surface area of the magnetic toner and the number of molecules of $CO_2$ gas adsorbed by the magnetic toners according to the present invention were measured by repeating the same procedure as described in Example 1. The results are as follows:

| | |
|---|---|
| Specific surface area of the magnetic toner | 1.76 m$^2$/g |
| The number of molecules of $CO_2$ gas adsorbed by the magnetic toner | 458.5/nm$^2$ |

Comparative Example

To 100 parts of the same fine particles (II) as described in Example 2 was added 0.3 parts of hydrophobic silica ("R-972", produced by Nippon Aerosil Co., Ltd.). The mixture was mixed for approximately 1 or 2 minutes by means of "Super Mixer" at a peripheral speed at the blade tip equal to at most 20 m/sec. to obtain a comparative magnetic toner, having an average particle diameter of 10 μm.

The specific surface area of the comparative magnetic toner and the number of molecules of $CO_2$ gas adsorbed by the comparative magnetic toner were measured by repeating the same procedure as described in Example 1. The results are as follows:

| | |
|---|---|
| Specific surface area of the comparative magnetic toner | 2.22 m$^2$/g |
| The number of molecules of $CO_2$ gas adsorbed by the comparative magnetic toner | 63.4/nm$^2$ |

The magnetic toners according to Examples 1 to 3 and Comparative Example were evaluated in connection with characteristics of rise time of triboelectrification by the following procedures:

1) 100 parts of a carrier of non-coated iron powder and 10 parts of each of the magnetic toners according to Examples 1 to 3 and Comparative Example were put in a beaker; and 2) while the mixture of the carrier and the magnetic toner was stirred with a magnetic stirrer, the triboelectrification of the mixture was measured at fixed intervals.

Here, the triboelectrification was measured by a magnet blow-off method, in which the magnetic toner is separated from the carrier by virtue of the difference of the magnetic forces thereof and the remaining electric charge of the carrier is measured.

The results are shown in Table 1 and plotted in FIG. 1.

As will be apparent from the results shown in Table 1 and FIG. 1, the magnetic toners according to the present invention exhibit a high triboelectrification and the triboelectrification of the magnetic toners reaches speedily the saturated value with a short time stirring.

TABLE 1

| | Results of characteristics of rise time of triboelectrification | | | |
|---|---|---|---|---|
| Stirring Time (sec.) | Example 1 | Example 2 | Example 3 | Comparative Example |
| 10 | −5.2 | −6.8 | −8.2 | −3.3 |
| 30 | −12.2 | −12.6 | −14.6 | −5.9 |
| 60 | −14.5 | −14.7 | −17.7 | −7.9 |
| 120 | −18.2 | −18.6 | −20.2 | −11.7 |
| 300 | −20.3 | −19.7 | −21.8 | −16.3 |
| 600 | −20.5 | −20.2 | −22.7 | −21.1 |

Furthermore, the magnetic toners according to Examples 1 to 3 and Comparative Example were evaluated in the case where each of the magnetic toners was set in both a copy machine using a single-component developing system and a laser printer using a two-component developing system, and 10,000 sheets were copied. The image density, smudging, and image quality of both the initial stage and the 10,000th copied sheet were evaluated. The results are shown in Table 2 and Table 3. In the case of evaluation tests using the laser printer, a developer obtained by mixing 15 parts of each of the magnetic toners and 100 parts of the carrier. The image density and smudging described in the tables were measured by process measurements Macbeth RD914 and brightness by Hunter, respectively and the image quality was evaluated by visual observation in accordance with the following:

○ Image quality good;

Δ Characters smudged; and

X Characters smudged and blurred.

TABLE 2

| | Evaluation results in a copy machine using a single-component developing system | | | | | |
|---|---|---|---|---|---|---|
| | Initial stage | | | After 10,000 sheets | | |
| | Image density | Smudging | Image quality | Image density | Smudging | Image quality |
| Example 1 | 1.38 | 0.42 | ○ | 1.32 | 0.46 | ○ |
| Example 2 | 1.39 | 0.48 | ○ | 1.34 | 0.47 | ○ |
| Example 3 | 1.39 | 0.42 | ○ | 1.37 | 0.39 | ○ |
| Comparative Example | 1.38 | 0.53 | Δ | 1.26 | 0.73 | X |

TABLE 3

| | Evaluation results in a laser printer using two-component developing system | | | | | |
|---|---|---|---|---|---|---|
| | Initial stage | | | After 10,000 sheets | | |
| Magnetic toner | Image density | Smudging | Image quality | Image density | Smudging | Image quality |
| Example 1 | 1.42 | 0.65 | ○ | 1.44 | 0.67 | ○ |
| Example 2 | 1.43 | 0.55 | ○ | 1.42 | 0.55 | ○ |
| Example 3 | 1.43 | 0.54 | ○ | 1.44 | 0.64 | ○ |
| Comparative Example | 1.40 | 0.66 | Δ | 1.31 | 1.12 | X |

As will be apparent from the results shown in Table 2 and Table 3, the magnetic toners of Examples 1 to 3 according to the present invention maintained both good image density and good image quality in the 10,000 copied sheet in both the copy machine with a single-component developing system and the laser printer with a two-component developing system. On the contrary, the comparative magnetic toner of Comparative Example exhibited poorer image quality in the 10,000 copied sheet than at the initial stage in both the copy machine using a single-component developing system and the laser printer using a two-component developing system. Furthermore, the 10,000 copied sheet with the comparative magnetic toner in both the copy machine using a single-component developing system and the laser printer using a two-component developing system had a poor image density. The 10,000 copied sheet with the comparative magnetic toner in the laser printer with a two-component developing system was much smudged.

As explained above, the present invention provides a magnetic toner by means of which multiple copies having good image quality and good density without smudging can be obtained in both a copy machine using a single-component developing system and a laser printer using a two-component developing system.

The present invention has been described in detail with respect to embodiments, and it will now be apparent from the foregoing to those skilled in the art that changes and modifications may be made without departing from the invention in its broader aspects, and it is the intention, therefore, in the appended claims to cover all such changes and modifications as fall with the true spirit of the invention.

What is claimed is:

1. A magnetic toner comprising a mixture of a magnetic material and a binder resin having particles of hydrophobic silica adhered to the surface thereof, wherein the magnetic toner has a specific surface area of not more than 3.0 $m^2/g$ computed by the Brunauer Emmett Teller equation and the number of molecules of $CO_2$ gas absorbed by the magnetic toner is $100/nm^2$ to $1000/nm^2$.

2. A magnetic toner as recited in claim 1, wherein the specific surface area represented by S ($m^2/g$) is calculated by the following equation:

$$S(m^2/g)=4.35\times Vm$$

wherein Vm (cc/g) is an adsorption needed to form a monomolecular layer on a surface of a magnetic toner; and the number of molecules of $CO_2$ gas adsorbed by the magnetic toner is computed by the following equation:

$$[\text{the number of molecules of } CO_2 \text{ gas adsorbed by a magnetic toner}]\ (\text{the number}/nm^2) = \frac{[\text{adsorbed } CO_2 \text{ gas}] \times 6.02 \times 10^{23}}{22414 \times [\text{the specific surface area}] \times 10^{18}}.$$

3. A magnetic toner as recited in claim 1, wherein the magnetic material is a material selected from the group consisting of magnetite and ferrite.

4. A magnetic toner as recited in claim 3, wherein the magnetic material is a sintered compact derived from a mixture of iron (III) oxide and an oxide of metal selected from the group consisting of nickel, zinc, manganese, magnesium, copper, lithium, barium, vanadium, chromium, and calcium.

5. A magnetic toner as recited in claim 1, wherein the binder resin is a material selected from the group consisting of polystyrene, polyethylene, polypropylene, a vinyl resin, polyacrylate, polymethacrylate, polyvinylidene chloride, polyacrylonitrile, polyether, polycarbonate, thermoplastic polyester, a cellulose resin; a copolymer resin of these materials; phenol resin; melamine resin; and urea resin.

6. A magnetic toner as recited in claim 1, which further comprises at least one material selected from the group consisting of a charge control agent and a coloring agent.

7. A magnetic toner as recited in claim 1, wherein the magnetic toner consists essentially of fine particles, the fine particles being produced by the steps of:

(a) mixing raw materials including a magnetic material and a binder resin to form a mixture;

(b) melt-kneading the mixture to form a melt-kneaded mixture;

(c) giving an appropriate impact force to the melt-kneaded mixture by a jet mill to form a pulverized mixture;

(d) classifying the pulverized mixture to obtain fine particles; and (e) mixing the fine particles with particles of hydrophobic silica to adhere the silica to the surfaces of the fine particles.

8. A magnetic toner as recited in claim 1, wherein the magnetic toner consists essentially of treated fine particles, the treated fine particles being produced by the steps of:

(a) mixing raw materials including a magnetic material and a binder resin to form a mixture;

(b) melt-kneading the mixture to form a melt-kneaded mixture;

(c) pulverizing the melt-kneaded mixture to form a pulverized mixture;

(d) classifying the pulverized mixture to obtain fine particles;

(e) treating the fine particles with an appropriate impact force to obtain treated fine particles; and mixing the treated fine particles with particles of silica to adhere the hydrophobic silica particles to the surfaces of the treated fine particles.

9. A magnetic toner as recited in claim 1, wherein the magnetic toner consists essentially of fine particles, the fine particles being produced by the steps of:

(a) mixing raw materials including a magnetic material and a binder resin to form a mixture;

(b) melt-kneading the mixture to form a melt-kneaded mixture;

(c) pulverizing the melt-kneaded mixture by a jet mill having a collision plate to form a pulverized mixture, wherein the jet mill has a pulverization pressure of 4–6 $kg/cm^2$ and an angle of a collision plate is set at 45°–90°;

(d) classifying the pulverized mixture to obtain particles having an average particle size of 8 to 20 μm; and (e) mixing the classified particles with colloidal silica to adhere the silica to the classified particles.

10. A magnetic toner as recited in claim 1, wherein the magnetic toner consists essentially of treated fine particles, the treated fine particles being produced by the steps of:

(a) mixing raw materials including a magnetic material and a binder resin to form a mixture;

(b) melt-kneading the mixture to form a melt-kneaded mixture;

(c) pulverizing the melt-kneaded mixture to form a pulverized mixture;

(d) classifying the pulverized mixture to obtain fine particles having an average article size of 8 to 20 μm;

(e) treating the fine particles with an impact force using a fluid stirrer to obtain treated fine particles; and mixing the treated fine particles with colloidal silica to adhere the silica to the treated fine particles.

11. A magnetic toner as recited in claim 1, wherein the magnetic toner consists essentially of treated fine particles, the treated fine particles being produced by the steps of:

(a) mixing raw materials including a magnetic material and a binder resin to form a mixture;

(b) melt-kneading the mixture to form a melt-kneaded mixture;

(c) pulverizing the melt-kneaded mixture to form a pulverized mixture;

(d) classifying the pulverized mixture to obtain fine particles having an average particle size of 8 to 20 μm;

(e) treating the fine particles with an impact force using a surface reformer to obtain treated fine particles; and mixing the treated fine particles with colloidal silica to adhere the silica to the surfaces of the treated particles.

* * * * *

UNITED STATES PATENT AND TRADEMARK OFFICE

CERTIFICATE OF CORRECTION

PATENT NO. : 5,561,018

DATED : October 01,1996

INVENTOR(S) : Yuichi Moriya

It is certified that error appears in the above-indentified patent and that said Letters Patent is hereby corrected as shown below:

The title page, showing an illustrative figure, should be deleted and substitute therefor the attached title page.

Figure 2:
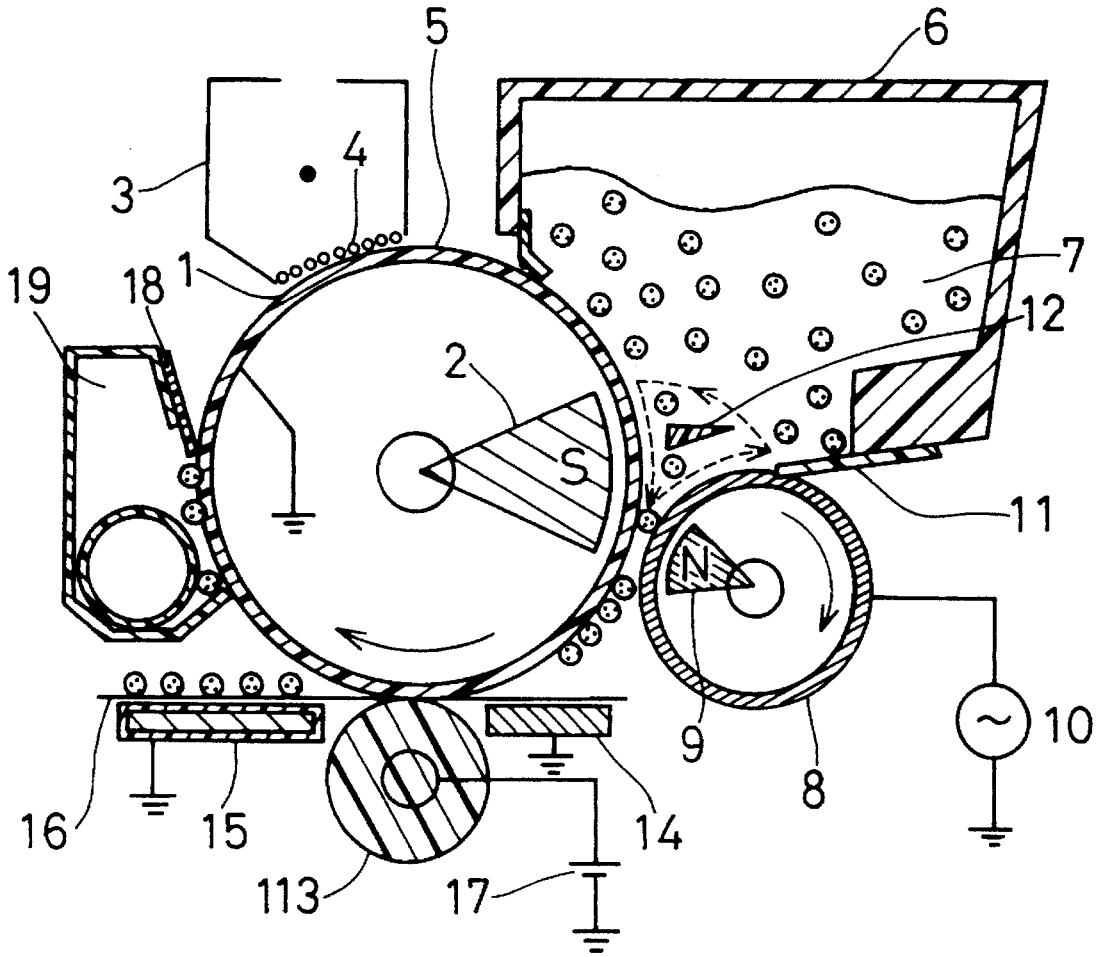
Figure 3:
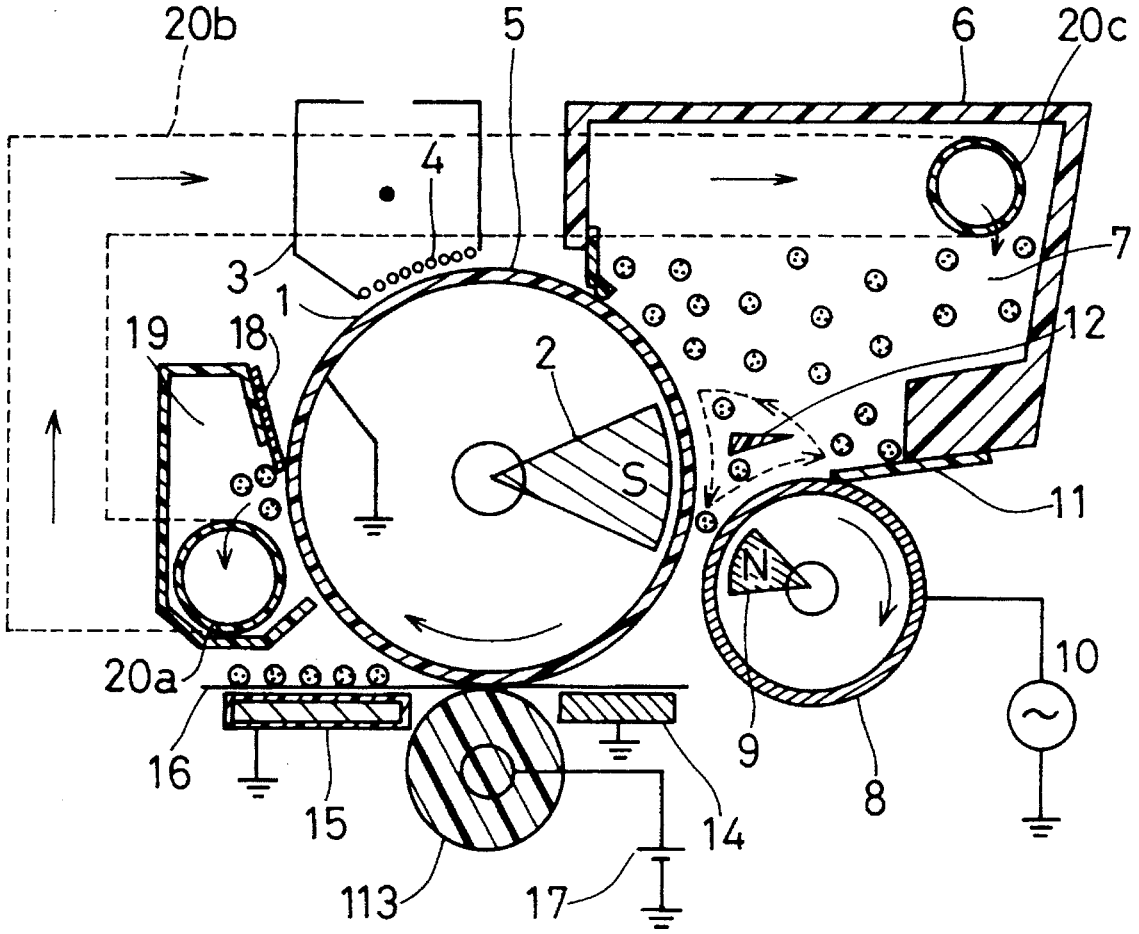
Figure 1:
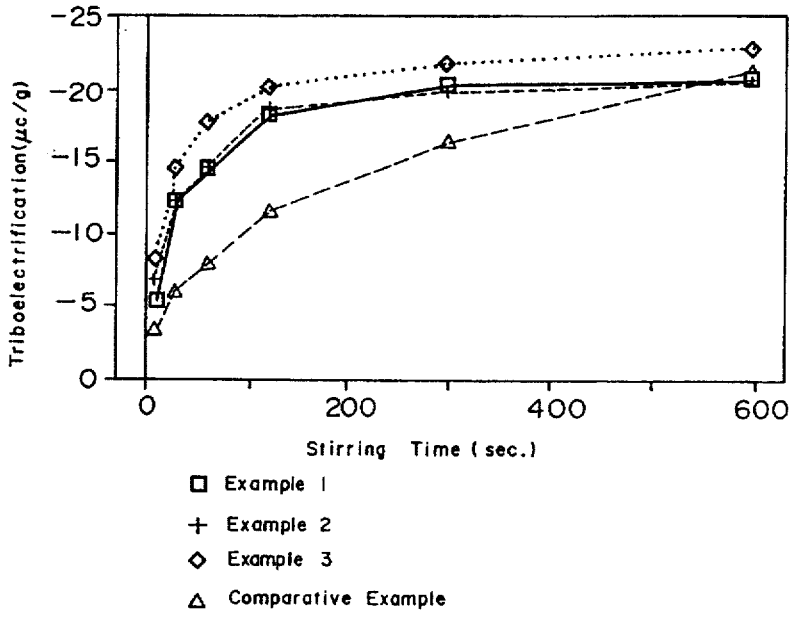

Delete Figures 1-3, and substitute therefor the Figure, consisting of Figure 1, as shown on the attached page.

Signed and Sealed this

Twenty-second Day of July, 1997

Bruce Lehman

*Attest:*

BRUCE LEHMAN

*Attesting Officer*

*Commissioner of Patents and Trademarks*

United States Patent [19]

Moriya

[11] Patent Number: 5,561,018

[45] Date of Patent: Oct. 1, 1996

[54] MAGNETIC TONER

[75] Inventor: Yuichi Moriya, Shizuoka, Japan

[73] Assignee: Tomoegawa Paper Co., Ltd., Tokyo, Japan

[21] Appl. No.: 344,628

[22] Filed: Nov. 17, 1994

Related U.S. Application Data

[63] Continuation of Ser. No. 74,011, Jun. 9, 1993, abandoned, which is a continuation of Ser. No. 681,892, Apr. 8, 1991, abandoned.

[30] Foreign Application Priority Data

Apr. 11, 1990 [JP] Japan ..... 2-93856

[51] Int. Cl.[6] ..... G03G 9/083

[52] U.S. Cl. ..... 430/106.6; 430/111; 430/137

[58] Field of Search ..... 430/106.6, 111, 430/137, 903

[56] References Cited

U.S. PATENT DOCUMENTS

| | | | |
|---|---|---|---|
| 4,946,755 | 8/1990 | Inoue | 430/106.6 |
| 5,223,365 | 6/1993 | Yamamoto et al. | 430/137 |
| 5,334,472 | 8/1994 | Aoki et al. | 430/110 |

FOREIGN PATENT DOCUMENTS

| | | |
|---|---|---|
| 0238130A2 | 9/1987 | European Pat. Off. . |
| 0357042A2 | 3/1990 | European Pat. Off. . |
| 0395026A2 | 10/1990 | European Pat. Off. . |
| 0410483A1 | 1/1991 | European Pat. Off. . |

*Primary Examiner*—Christopher D. Rodee

*Attorney, Agent, or Firm*—Finnegan, Henderson, Farabow, Garrett & Dunner, L.L.P.

[57] ABSTRACT

A magnetic toner having a specific surface area of not more than 3.0 $m^2/g$ computed by the Brunauer Emmett Teller equation and the number of molecules of $CO_2$ gas, being equal to $100/nm^2$ to $1000/nm^2$, adsorbed by the toner is provided. The triboelectrification of magnetic toner particles of the magnetic toner is uniformed by adjusting the magnetic toner using an impact force so that the specific surface area of the magnetic toner and the number of molecules of $CO_2$ gas adsorbed by the toner are presented in the range described above.

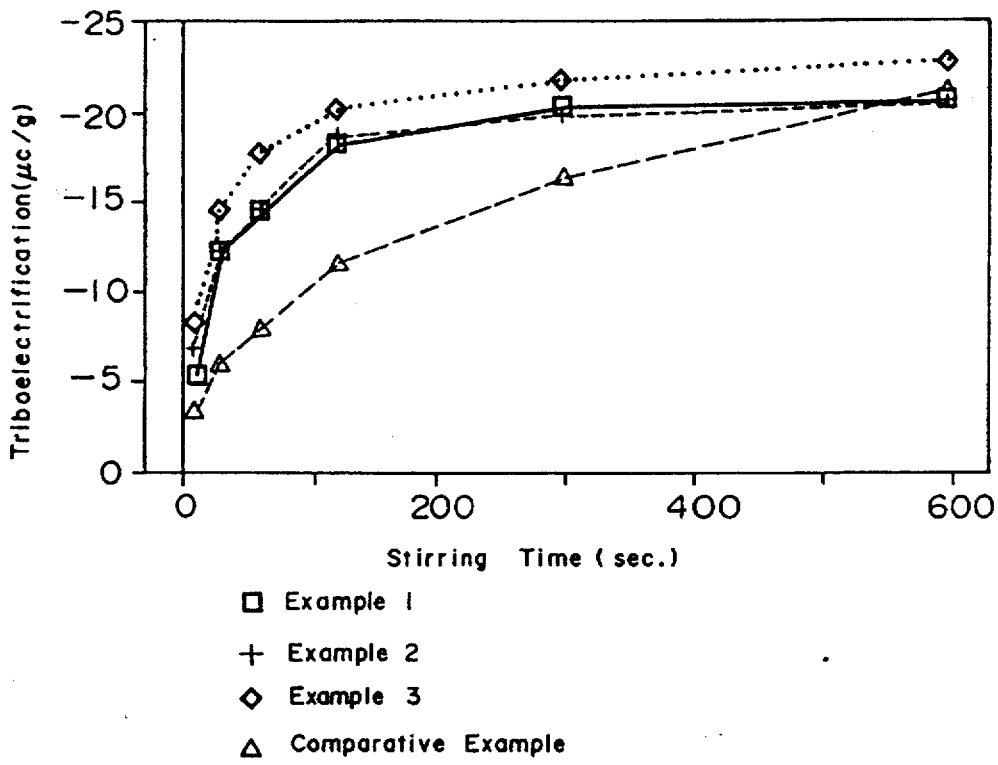

11 Claims, 3 Drawing Sheets